US009883780B2

(12) United States Patent
Kim et al.

(10) Patent No.: US 9,883,780 B2
(45) Date of Patent: Feb. 6, 2018

(54) CLEANING MEMBER AND CLEANER HAVING THE SAME

(71) Applicant: SAMSUNG ELECTRONICS CO., LTD., Suwon-si, Gyeonggi-do (KR)

(72) Inventors: In Shik Kim, Seongnam-si (KR); Seong Hun Ahn, Incheon (KR); Yang Jic Lee, Gwacheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 312 days.

(21) Appl. No.: 14/636,312

(22) Filed: Mar. 3, 2015

(65) Prior Publication Data

US 2015/0250368 A1 Sep. 10, 2015

(30) Foreign Application Priority Data

Mar. 7, 2014 (KR) ..... 10-2014-0027399

(51) Int. Cl.

| | |
|---|---|
| ***A47L 9/14*** | (2006.01) |
| ***A47L 9/12*** | (2006.01) |
| ***A47L 9/06*** | (2006.01) |
| ***A47L 5/28*** | (2006.01) |
| ***A47L 9/02*** | (2006.01) |

(52) U.S. Cl.

CPC ..... *A47L 9/12* (2013.01); *A47L 5/28* (2013.01); *A47L 9/02* (2013.01); *A47L 9/0686* (2013.01); *A47L 9/14* (2013.01)

(58) Field of Classification Search

CPC . A47L 9/0686; A47L 5/28; A47L 9/02; A47L 9/12; A47L 9/14

See application file for complete search history.

(56) References Cited

U.S. PATENT DOCUMENTS

| | | | | |
|---|---|---|---|---|
| 7,293,322 | B2 * | 11/2007 | Matousek | A47L 9/02 15/320 |
| 2004/0134016 | A1 * | 7/2004 | Kisela | A47L 5/24 15/320 |
| 2010/0024157 | A1 * | 2/2010 | Vernon | A47L 5/28 15/403 |
| 2011/0088209 | A1 * | 4/2011 | Ivarsson | A47L 9/0686 15/393 |

FOREIGN PATENT DOCUMENTS

| | | | |
|---|---|---|---|
| JP | 2008-206944 | 9/2008 | |
| WO | WO 2013188063 A1 * | 12/2013 | A47L 11/33 |

* cited by examiner

*Primary Examiner* — Marc Carlson

(74) *Attorney, Agent, or Firm* — Staas & Halsey LLP

(57) ABSTRACT

A cleaner including a cleaner body provided with a driving part configured to generate a suction force, a head unit connected to the cleaner body and configured to come into close contact with a surface to be cleaned by allowing external air to be introduced thereinto by the suction force of the driving part, and a cleaning member detachably provided on the head unit, wherein the cleaning member includes a member body detachably coupled to the head unit and having a floor cleaning part making contact with the surface to be cleaned, and a dust collecting container extending from the member body and configured to filter out foreign substances from air that is suctioned into the head unit.

16 Claims, 23 Drawing Sheets

(a)

(b)

(c)

CLEANING MEMBER AND CLEANER HAVING THE SAME

CROSS-REFERENCE TO RELATED APPLICATIONS

This application claims the benefit of Korean Patent Application No. 10-2014-0027399, filed on Mar. 7, 2014, in the Korean Intellectual Property Office, the disclosure of which is incorporated herein by reference.

BACKGROUND

1. Field

Embodiments of the present disclosure relate to a cleaning member and a cleaner having the same, and more particularly, to a cleaning member provided with a compact structure and a cleaner having the same.

2. Description of the Related Art

A cleaner represents an appliance designed to facilitate cleaning, and general examples of the cleaner may include a vacuum cleaner for collecting foreign substances using a suction force generated by a motor and a cleaner for mopping the floor.

In general, a vacuum cleaner includes a head unit configured to come into close contact with a surface that is to be cleaned, and a body configured to generate a suction force, such that foreign substances on the surface to be cleaned are suctioned by a suction force.

Meanwhile, the cleaner for mopping the floor is not provided with an apparatus for generating a suction force, but has dust clothes mounted at a head unit thereof, to mop foreign substances on a surface to be cleaned by repeatedly moving back and forth.

When the vacuum cleaner is used separately from the cleaner for mopping the floor, the cleaning process is complicated, and cumbersome to a user.

SUMMARY

Therefore, it is an aspect of the present disclosure to provide a cleaning member capable of improving a cleaning efficiency and a cleaner having the same.

It is another aspect of the present disclosure to provide a cleaning member having a compact structure, and a cleaner having the same.

Additional aspects of the disclosure will be set forth in part in the description which follows and, in part, will be apparent from the description, or may be learned by practice of the disclosure.

In accordance with one aspect of the present disclosure, a cleaner includes a cleaner body, a head unit and a cleaning member. The cleaner body may be provided with a driving part configured to generate a suction force. The head unit may be connected to the cleaner body and configured to come into close contact with a surface to be cleaned by allowing external air to be introduced thereinto by the suction force of the driving part. The cleaning member may be detachably provided on the head unit. The cleaning member may include a member body detachably coupled to the head unit and having a floor cleaning part making contact with the surface to be cleaned, and a dust collecting container extending from the member body and configured to filter out foreign substances from air that is suctioned into the head unit.

The dust collecting container may include a container body provided at an inside the head unit and having a dust collecting space in which foreign substances are collected, to perform filtering on air introduced into the head unit; and an inlet part configured to form an opening through which air is introduced into the dust collecting space, the inlet part formed at an end portion of the container body.

The head unit may include a head body provided at an inside thereof with an inner space, and the container body may be disposed in the inner space of the head unit by the suction force of the driving part.

The head unit may include a bottom surface that comes into close contact with the floor cleaning part; and an entry part provided on the bottom surface and allowing air to be introduced therethrough by the driving part.

At least one portion of the dust collecting container may be introduced by the suction force of the driving part and disposed inside the head unit.

The dust container may be integrally formed with a front side of the member body.

The cleaning member may further include a backflow preventing rib that extends from the member body and movably provided between an opening position at which the opening is opened and a closing position at which the opening is closed depending on generation of the suction force by the driving part.

The head unit may include an entry part allowing external air to be introduced therethrough by the suction force of the driving part and having the opening of the dust collecting container positioned thereon; and a backflow preventing unit provided adjacent to the entry part and configured to move back and forth to open and close the entry part and the opening.

The head unit may include an entry part allowing external air to be introduced therethrough by the suction force of the driving part; and a backflow preventing protrusion adjacent to the entry part and configured to be projected inward the head unit to confine one side of the opening when the driving part stops generating the suction force and the container body is inclined due to deadweight.

The cleaning member may further include an inside cleaning member provided inside the member body to absorb moisture.

The cleaning member may further include an inlet fixing part configured to allow at least one portion of the inlet part to be fixed such that the opening is kept open, the inlet fixing part extending from the inlet part.

One side of the inlet part may be fixed as the member body integrally formed with the inlet part is attached to the head unit, and the other side of the inlet part may be fixed as the inlet fixing part is fixed to a front surface of the head unit, so that the opening of the inlet part is kept open.

The head unit may include a mounting part on which the inlet fixing part is mounted; and a fixing part provided on the mounting part, the fixing part formed of elastic member and radially being slit to act an elastic force such that at least one portion of the inlet fixing part is introduced into the fixing part and prevented from being randomly separated.

The head unit may include a fixing cover configured to primarily cover the fixing part and secondarily fix the inlet fixing part.

The cleaner may further include a joint part allowing the bottom surface of the head unit to be parallel to the surface to be cleaned when the cleaner body operates, wherein the joint part includes a flexible tube forming the external appearance of the joint part and provided to be deformable; a plurality of joints provided in the flexible tub and allowing the head unit to perform a joint movement with respect to the body, wherein a flow path is provided between the flexible tube and the plurality of joints to allow the air suctioned by the driving part to move therealong.

The cleaner body may further include an exit part allowing the air introduced from the head unit to be discharged, wherein the entry part, the dust collecting container, the driving part and the exit part may be sequentially disposed in a flow direction of air introduced from outside.

In accordance with another aspect of the present disclosure, a cleaning member detachably provided on a cleaner provided with a head unit configured to suction air includes: a member body detachably provided on the head unit and making contact with a surface to be cleaned; and a dust collecting container extending from the member body and provided in a pocket shape to filter out foreign substances introduced to the inside of the cleaner. The dust collecting container may be integrally formed with a front surface of the member body.

The dust collecting container may include: an inlet part provided on the dust collecting container to form an opening that allows air to be introduced to the inside of the dust collecting container; and an inlet fixing part configured to allow at least one portion of the inlet part to be fixed such that the opening is kept open, the inlet fixing part extending from the inlet part.

In accordance with another aspect of the present disclosure, a cleaner includes a cleaner body provided with a driving part configured to generate a suction force; a head unit including a head body having an inner space therein and a bottom surface provided on an outer surface of a bottom of the head body, the head unit provided to perform a joint movement with respect to the cleaner body and coming into close contact with a surface to be cleaned; and a cleaning member detachably provided on the head unit to clean the surface to be cleaned, wherein the cleaning member may include a bottom cleaning part making contact with the surface to be cleaned; and a dust collecting container provided adjacent to the bottom cleaning part at an inside of the head unit to filter out foreign substances of external air introduced by the suction force of the driving part.

As is apparent from the above, the cleaning member according to the present disclosure and the cleaner having the same can suction foreign substance on a surface to be cleaned and also perform a wet cleaning.

In addition, the cleaning member according to the present disclosure and the cleaner have the same can be provided with a compact structure and thus easily stored, thereby ensuring convenience of a user and providing an aesthetic design.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
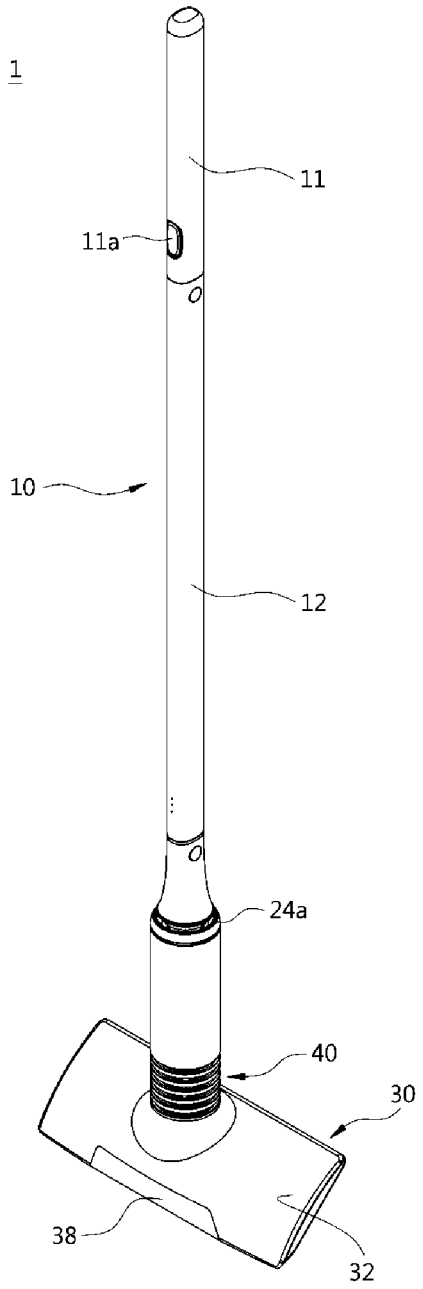
FIGS. 1 and 2 are perspective views illustrating a cleaner in accordance with the first embodiment of the present disclosure.

Reference will now be made in detail to the embodiments of the present disclosure, examples of which are illustrated in the accompanying drawings, wherein like reference numerals refer to like elements throughout.

Figure 2:
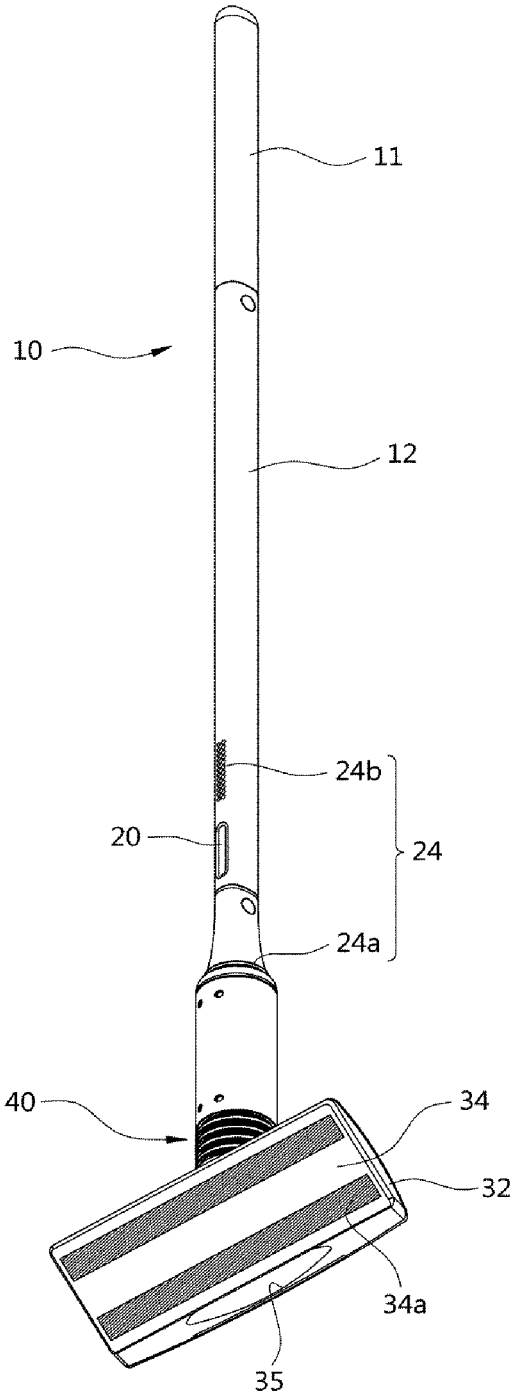
Figure 3:
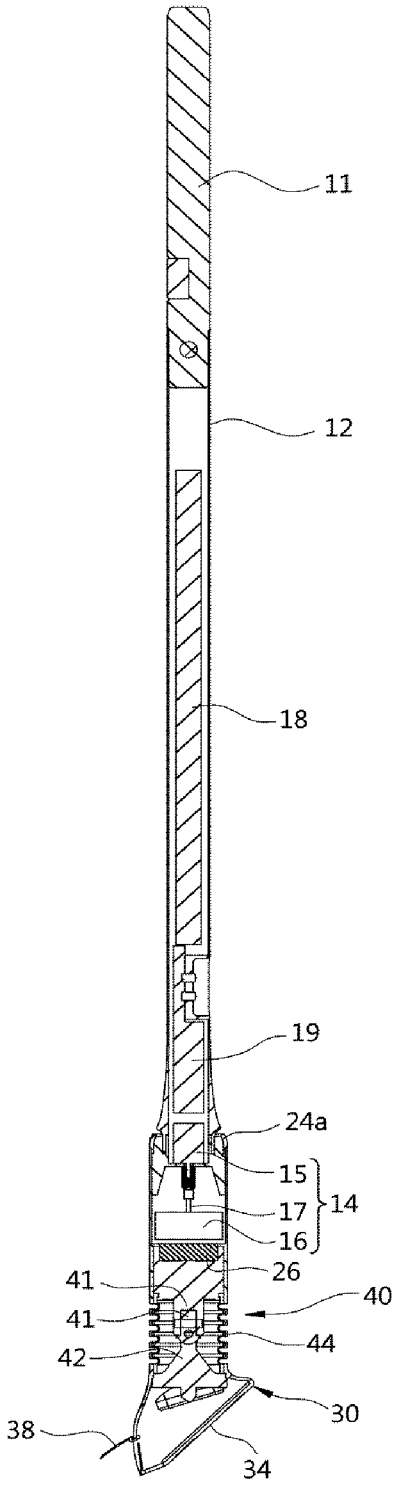
FIG. 3 is a cross-sectional view illustrating the cleaner in accordance with the first embodiment of the present disclosure.
Figure 4:
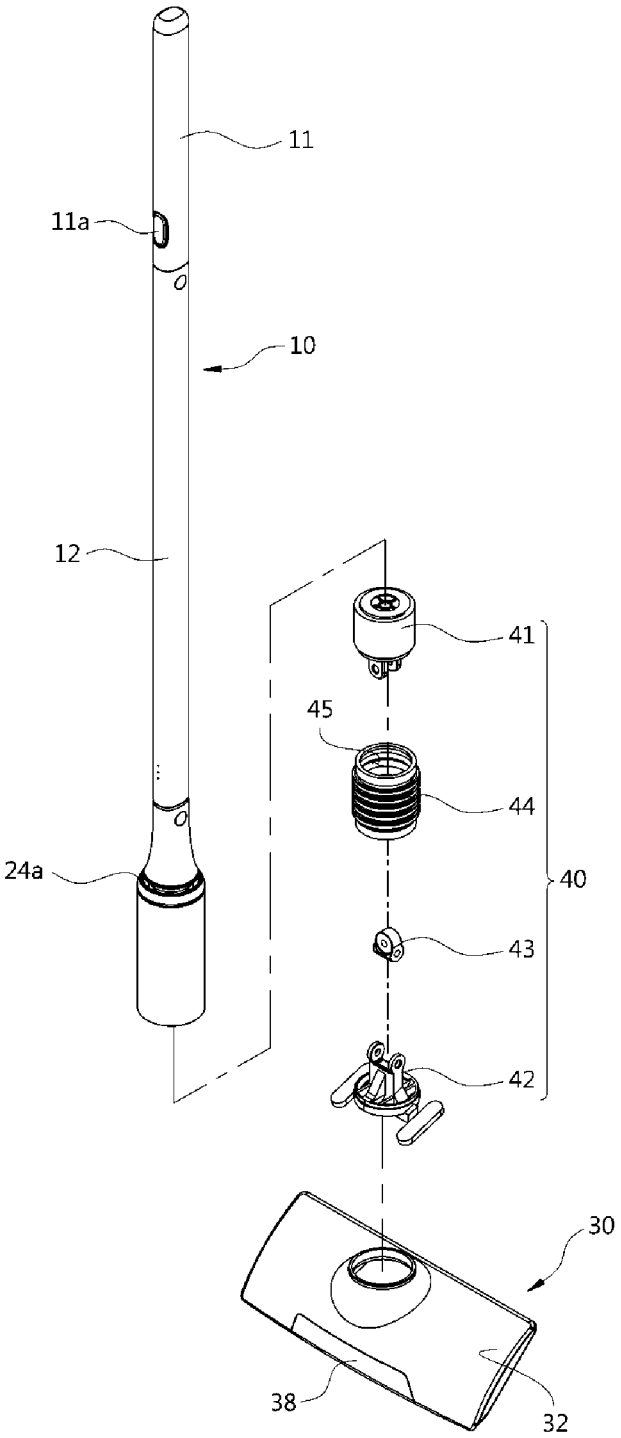
FIG. 4 is an exploded perspective view illustrating the cleaner in accordance with the first embodiment of the present disclosure.

FIGS. 1 and 2 are perspective views illustrating a cleaner in accordance with the first embodiment of the present disclosure, FIG. 3 is a cross-sectional view illustrating the cleaner in accordance with the first embodiment of the present disclosure, and FIG. 4 is an exploded perspective view illustrating the cleaner in accordance with the first embodiment of the present disclosure.

A cleaner 1 according to the first embodiment of the present disclosure includes a cleaner body 10 and a head unit 30.

The cleaner body 10 forms a structure of the cleaner 1, and is provided in an approximate rod shape. The cleaner body 10 may include a handle grip 11, a cleaning rod 12 and a driving part 14.

The cleaner body 10 is provided with the handle grip 11 allowing a user to manipulate the cleaner 1. A button part 11*a* is provided on the handle grip 11 to adjust on/off or suction power of the cleaner 1.

The driving part 14 may be provided inside the cleaner body 10, and include a motor 15 and a driving fan 16. The driving part 14 is configured to generate a suction force for suctioning outside air. In detail, the motor 15 rotates a driving shaft 17 by using electric energy, and the driving shaft 17 is connected to the center portion of the driving fan 16 to suction outside air of the cleaner 1 according to rotation of the driving fan 16.

The cleaner rod 12 is provided in a shape approximate to that of the cleaner body 10. The cleaner rod 12 is provided to connect the handle grip 11 to the driving part 14. Although not shown in the drawings, the cleaner rod 12 is provided to have a length thereof varied.

The cleaner body 10 is provided with a battery 18 and a controller 19 therein.

The controller 19 is provided to control the cleaner 1 using an electric signal related to an operation of the cleaner body 10. The battery 18 is connected to the controller 19 or the driving part 14, to supply the cleaner 1 with electric energy.

A charging port 20 may be provided on the cleaner body 10. That is, the battery 18 may be supplied with electric energy as the charging port 20 is connected to an external power source through a charging cable, so that the cleaner 1 is able to operate through charging without needing an electric cord.

An operation display part is formed on the cleaner body 10, and when the cleaner 1 operates, the operation state is visually viewed from outside such that the current operation state is identified and also aesthetic quality is improved.

The cleaner body 10 is provided with an exit part 24 allowing the introduced air to be discharged. That is, the exit part 24 is an element corresponding to an entry part 35 of the head unit 30 that will be described later. The exit part 24 is provided to allow air that is introduced through the entry part 35 to be discharged to the outside therethrough after foreign substances are filtered by a dust collecting container 70 or a filter member 26.

The exit part 24 may include a main exit part 24*a* and a subsidiary exit part 24*b*. The main exit part 24*a* is provided on the driving part 14 to discharge air suctioned to the inside of the cleaner body 10 by the driving fan 16. The main exit part 24*a* is formed along the driving part 14, and provided at a downstream side on an air flow path when compared to the driving fan 16.

The subsidiary exit part 24*b* is provided to discharge air introduced to the inside of the cleaner body 10 by the driving fan 16 in cooperation with the main exit part 24*a*. The subsidiary exit part 24*b* is provided to discharge air that fails to be discharged through the main exit part 24*a* and remains, thereby improving the suction force of the cleaner body 10.

In addition, the subsidiary exit part 24*b* is provided to dissipate heat of the controller 19. The subsidiary exit part 24*b* is disposed on an upper side of the controller 19, that is, at a downstream side on an air flow path passing the controller 19, thereby dissipating heat generated from the controller 19.

The cleaner body 10 is provided on the air flow path, and is provided with the filter member 26 that is configured to filter fine dust that is not caught by the dust collecting container 70 which will be described later.

The filter member 26 is provided at an upstream side on the air flow path when compared to the driving part 14 to prevent foreign substances from being accumulated on the driving part 14. In addition, the filter member 26 serves to additionally filter foreign substance, thereby allowing cleaner air to be discharged through the exit part 24. The type of the filter member 26 is not limited, and the filter member 26 according to the first embodiment of the present disclosure may include a high efficiency particulate arresting (HEPA) filter.

Figure 5:
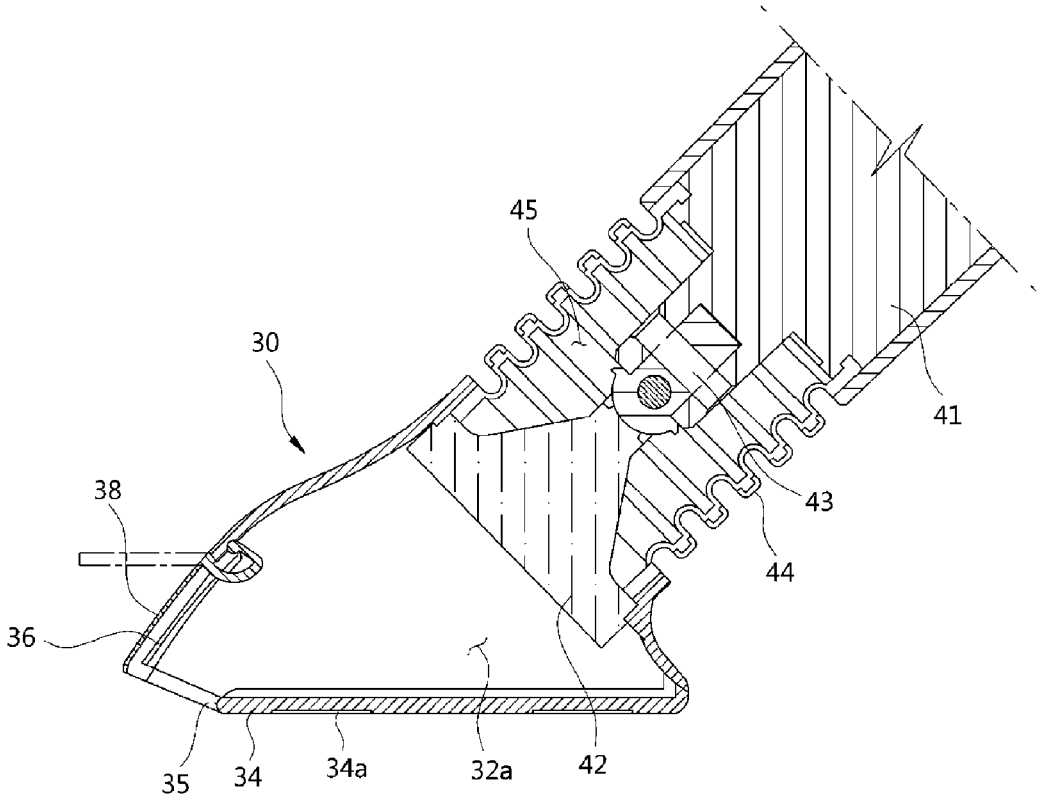
FIG. 5 is a cross-sectional view illustrating a head unit of the cleaner in accordance with the first embodiment of the present disclosure.
Figure 6:
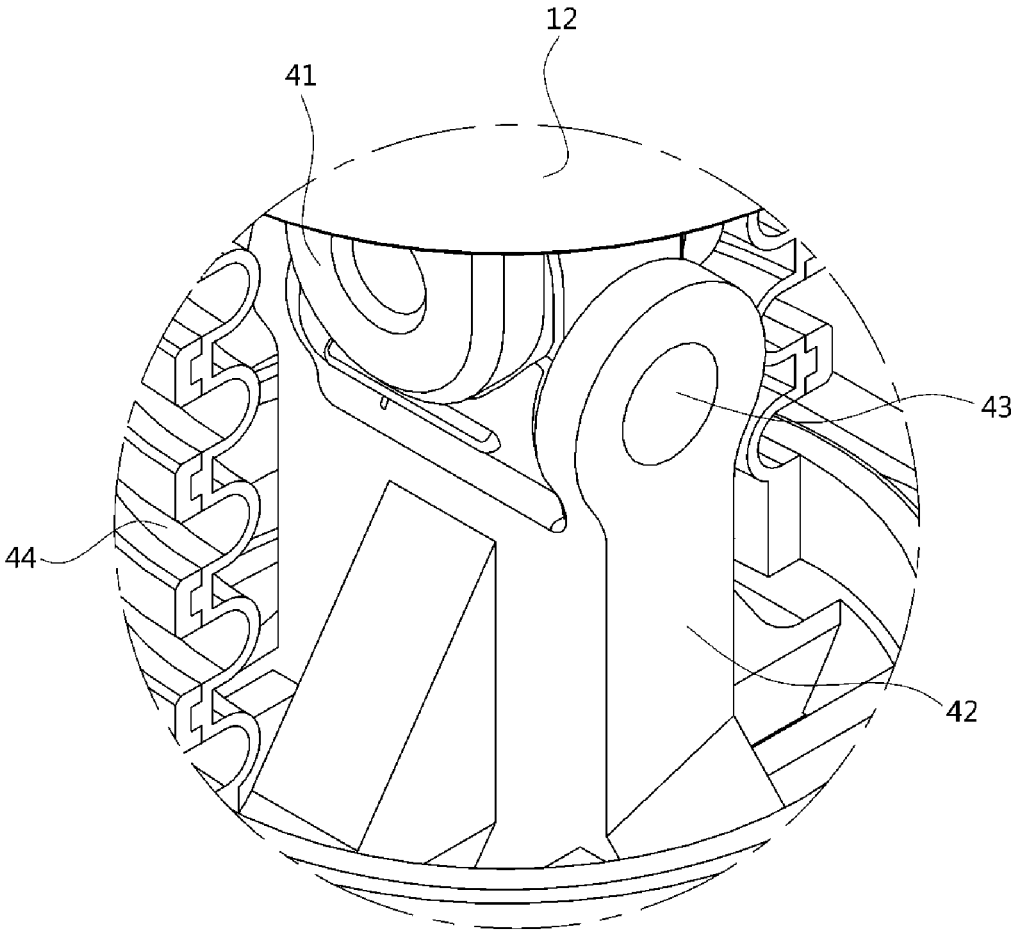
FIG. 6 is an enlarged perspective view illustrating a joint part of the cleaner in accordance with the first embodiment of the present disclosure.

FIG. 5 is a cross sectional view illustrating a head unit of the cleaner in accordance with the first embodiment of the present disclosure, and FIG. 6 is an enlarged perspective view illustrating a joint part of the cleaner in accordance with the first embodiment of the present disclosure.

The cleaner 1 includes the head unit 30 that is configured to come into close contact with the surface to be cleaned.

The head unit 30 is connected to a joint part 40 that will be described later, so as to be disposed in various directions. In detail, the head unit 30 may perform yaw, pitch and roll movements with respect to the cleaner body 10 through the joint part 40.

The head unit 30 includes a head body 32 having an inner space 32*a* therein, a bottom surface 34, formed on a lower surface of the head body 32 and having a cleaner member 50, which will be described later, attached thereto, and an entry part 35 provided at a lower side of the head body 32 and allowing outside air to be introduced through the suction force of the driving part 14.

The bottom surface 34 is provided with an approximate flat surface, and disposed to face the surface to be cleaned. The bottom surface 34 may be provided with an attachment member 34*a* to which the cleaning member 50 is attached. The attachment member 34*a* is provided in various configurations as long as the cleaning member 50 is attached to the attachment member 34*a*. The attachment member 34*a* according to the first embodiment of the present disclosure may be provided using a Velcro tape. The cleaning member 50 is formed of felt, and a member body 52 is fixed to the head unit 30 by the Velcro tape.

The entry part 35 is provided at a lower side of the head body 32 such that outside air is introduced through the entry part 35. Although the entry part 35 according to the first embodiment of the present disclosure is provided on the bottom surface 34 and disposed at a front side of the head unit 30, the disposition of the entry part 35 is not limited thereto.

The entry part 35 is provided to correspond to the dust collecting container 70 of the cleaning member 50 that will be described later. The entry part 35 is provided such that foreign substances contained in outside air introduced through the entry part 35 are filtered by the dust collecting container 70 in the inner space 32*a* of the head body 32.

The entry part 35 has a shape corresponding to the bottom surface 34, and is disposed at a front side of the bottom surface 34. That is, foreign substances having a predetermined size or above are suctioned through the entry part 35, and foreign substances that remain without being suctioned are wiped by a bottom cleaning part 60 disposed on the bottom surface 34. To this end, the entry part 35 may be provided in a longitudinal shape corresponding to that of the bottom surface 34.

The cleaner 1 may include the joint part 40 allowing the head unit 30 to perform a joint movement with respect to the cleaner body 10. The head unit 30 is provided to perform yaw, pitch and roll movements with respect to the cleaner body 10 through the joint part 40.

The joint part 40 may include a plurality of joints and a flexible tube 44.

The plurality of joints may include an upper joint 41 and a lower joint 42. The upper joint 41 is connected to the cleaner body 10, and the lower joint 42 is connected to the head unit 30. The upper joint 41 is connected to the lower joint 42 through a middle joint 43.

The flexible tube 44 is provided to prevent the plurality of joints from being exposed to the outside, and allows the head unit 30 to operate while bending in various directions.

A flow path 45 is formed between the flexible tube 44 and the plurality of joints to allow air introduced from outside to pass therethrough. As for the cleaner according to the present disclosure, the dust collecting container 70 configured to filter out foreign substance of air introduced from outside is disposed at an upstream side when compared to the joint part 40, so that the joint part 40 and the flow path 45 may be disposed together. Accordingly, the aesthetic quality is improved and a simpler configuration is achieved. In addition, the entry part 35, the dust collecting container 70, the driving part 14 and the exit part 24 are sequentially disposed in the flow direction of air introduced from outside, and thus a flow path of the air is minimized, thereby maximizing the suction efficiency.

Figure 7:
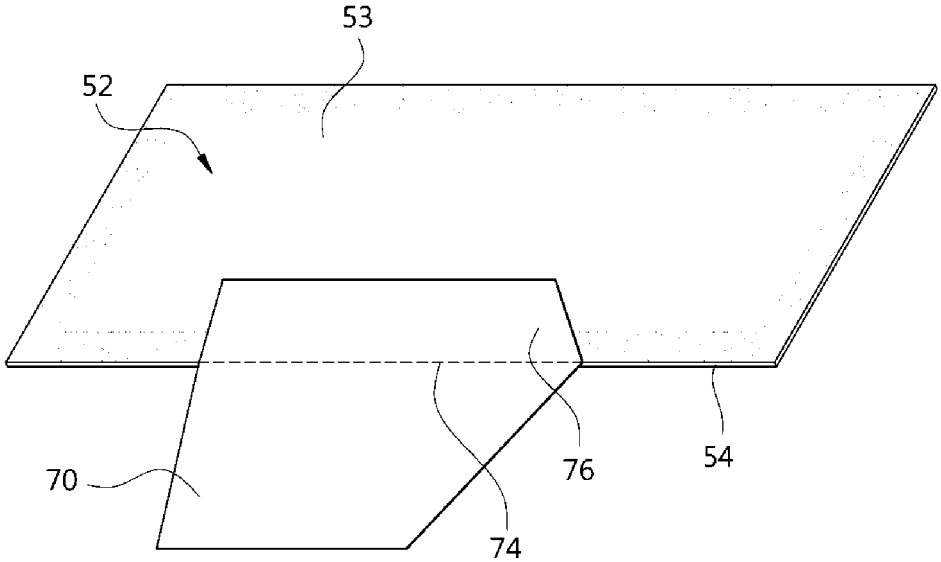
FIG. 7 is a perspective view illustrating a cleaning member in accordance with the first embodiment of the present disclosure.
Figure 8:
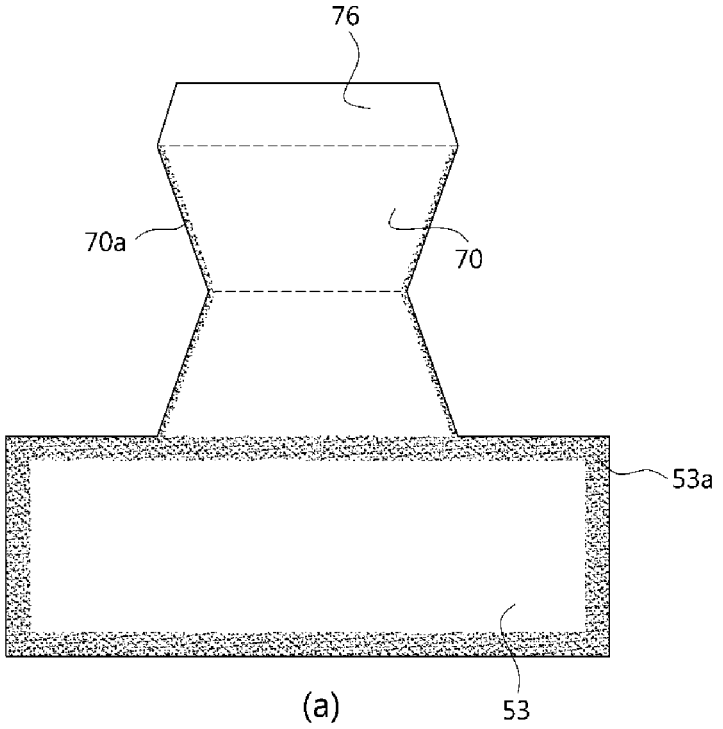
FIG. 8 is an exploded view illustrating the cleaning member in accordance with the first embodiment of the present disclosure.
Figure 8:
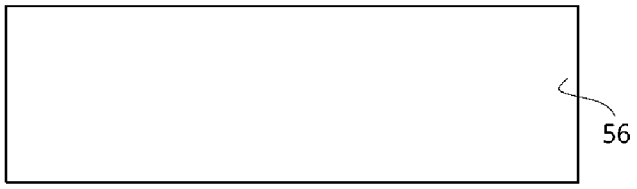
Figure 8:
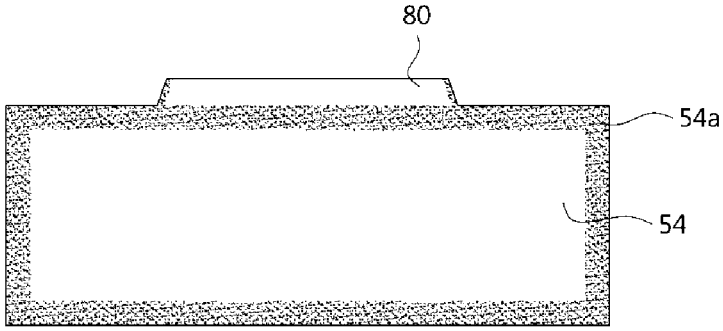

FIG. 7 is a perspective view illustrating a cleaning member in accordance with the first embodiment of the present disclosure, and FIG. 8 is an exploded view illustrating the cleaning member in accordance with the first embodiment of the present disclosure.

The cleaning member 50 is attached to a lower portion of the head unit 30 to clean the surface to be cleaned. The cleaning member 50 is detachably provided on the head unit 30, and when the cleaning is completed, the cleaning member 50 is separated from the head unit 30 and washed or replaced with another cleaning member 50. The cleaning member 50 includes the member body 52 and an inside cleaning member 56.

At least one portion of the cleaning member 50 is formed of felt. However, the material of the cleaning member 50 is not limited thereto, and the cleaning member 50 may be provided using various material as long as it passes air having foreign substance filtered therefrom.

The member body 52 may include an upper body 53 and a lower body 54. The member body 52 may be separably provided on the head unit 30. In detail, the upper body 53 of the member body 52 is attached to the attachment member 34*a* provided on the bottom surface 34 of the head unit 30 such that the member body 52 is separable. The upper body 53 is coupled to the lower body 54 through heat bonding, but the coupling of the upper body 53 and the lower body 54 is not limited thereto. According to the first embodiment of the present disclosure, the upper body 53 is coupled to the lower body 54 by thermal bonding edges 53*a* and 54*a* to each other.

The inside cleaning member 56 is provided inside the member body 52. The inside cleaning member 56 is provided using moisture absorbing pulp that holds moisture inside the member body 52, but the material of the inside cleaning member 56 is not limited.

According to such a configuration, the surface to be cleaned is wet cleaned through the member body 52 and the inside cleaning member 56, and foreign substances that are not introduced through the entry part 35 and an inlet part 74, which will be described later, are cleaned.

The cleaning member 50 may include the bottom cleaning part 60 and the dust collecting container 70. The bottom cleaning part 60 is provided to make contact with the surface to be cleaned. That is, the bottom cleaning part 60 is disposed at the lower body 54 so as to face the surface to be cleaned. The shape of the bottom cleaning part 60 is not limited, and may be provided in a curved shape or flat shape.

The dust collecting container 70 has a filtering function to filter out foreign substances of air introduced to the entry part 35 of the head unit 30 by the driving force generated by the driving part 14. That is, the dust collecting container 70 may be integrally formed with the member body 52. In detail, the dust collecting container 70 may form a part of the upper body 53. The dust collecting container 70 is formed at an end portion of the front side of the cleaner 1, and disposed at a front side of the bottom cleaning part 60. That is, the dust collecting container 70 is formed adjacent to the member body 52, so that the dust collecting container 70 serves to suction and collect foreign substances and the member body 52 serves to wipe foreign substances on the surface to be cleaned. The dust collecting container 70 is provided in an approximate pocket shape.

The dust collecting container 70 may include a container body 72 and the inlet part 74.

The container body 72 is formed to have a dust collecting space 72*a* therein. When the cleaning member 50 is attached to the bottom surface 34 of the head unit 30 before a cleaning operation, the dust collecting container 70 is provided to be exposed to the outside. However, when the cleaner 1 operates and air for suctioning stuffs into the entry part 35 is generated, the container body 72 is suctioned together with the air and thus is disposed in the inner space 32*a* of the head unit 30. As the dust collecting container 70 moves into the inner space 32*a* of the head unit 30, the dust collecting container 70 forms the dust collecting space 72*a*.

The container body 72 may be formed of the same material as the cleaning member 50, but the material of the container body 72 is not limited thereto. The container body 72 may formed of various material as long as it passes air having foreign substances filtered therefrom.

The inlet part 74 is formed at an end portion of the container body 72 to form an opening 74*a* allowing air to be introduced into the dust collecting space 72*a*. That is, the inlet part 74 is provided at an upstream side of the air flow path of suctioned air when compared to the container body 72.

One side of the inlet part 74 is fixed by the member body 52, and the other side of the inlet part 74 is fixed as an inlet fixing part 76 is fixed to the head unit 30.

The inlet fixing part 76 is provided to be formed along at least one portion of the inlet part 74 forming the opening 74*a*. According to the first embodiment of the present disclosure, the inlet fixing part 76 is disposed at a front side of the inlet part 74 and fixed to the front surface of the head unit 30. The inlet fixing part 76 extends from the inlet part 74 and allows at least one portion of the inlet part 74 to be fixed such that the opening 74 is kept open.

That is, one side of the inlet part 74 is fixed as the member body 52 integrally formed with the inlet part 74 is attached or coupled to the head unit 30, and the other side of the inlet part 74 is fixed as the inlet fixing part 76 is fixed to the front surface of the head unit 30 such that the opening 74*a* of the inlet part 74 is kept open.

The head unit 30 is provided with a mounting part 36 and a fixing part 36*a* formed at a front side thereof. The mounting part 36 is provided at a position corresponding to the inlet fixing part 76 such that the inlet fixing part 76 is mounted on the mounting part 35. The fixing part 36*a* is formed of elastic member and radially slit such that at least one portion of the inlet fixing part 76 is introduced into the fixing part 36*a* and prevented from being randomly separated by an elastic force.

The head unit 30 may include a fixing cover 38 provided at a front side of the head unit 30 to cover the fixing part 36*a* to which the inlet fixing part 76 is fixed. The fixing cover 38 is provided to open and close the fixing part 36*a*. Such a configuration allows the inlet fixing part 76 to be secondarily fixed.

The dust collecting container 70 is formed by thermally bonding edges 70*a* of two planes each having a trapezoidal shape to each other.

The cleaning member 50 may include a backflow preventing rib 80.

The backflow preventing member 80 is provided to prevent foreign substances accumulated on the dust collecting container 70 from being discharged to the outside again. The backflow preventing rib 80 is provided in a shape corresponding to the inlet part 74, and disposed on the lower body 54.

When the driving part 14 operates, a suction force is generated by the driving part 14 in the container body 72 such that foreign substances are pushed in the direction of the suctioned air in the container body 72. When the driving part 14 stops operating, the suction force also stops being generated. In this process, the foreign substances drop downward, and discharged to the outside through the inlet part 74. In order to prevent the foreign substances from being discharged to the outside, the backflow preventing rib 80 is formed to block the opening 74*a* of the inlet part 74. That is, the backflow preventing rib 80 is formed to have one end thereof oriented toward the dust collecting space 72*a* of the container body 72 by the suction force when the driving part 14 operates, and the backflow preventing rib 80 is provided to block the opening 74*a* of the inlet part 74 by the suction force disappearing when the driving part 14 stops operating. In this manner, the foreign substances inside the container body 72 are prevented from being discharged to the outside.

In other words, the backflow preventing rib 80 extends from the member body 52 and is provided to move between an opening position 80*a* in which the opening 74*a* of the dust collecting container 70 is open and a closing position 80*b* in which the opening 74*a* is closed depending on generation of the suction force by the driving part 14.

Hereinafter, a flow of the suctioned air according to the operation of the cleaner 1 will be described.

Figure 9A:
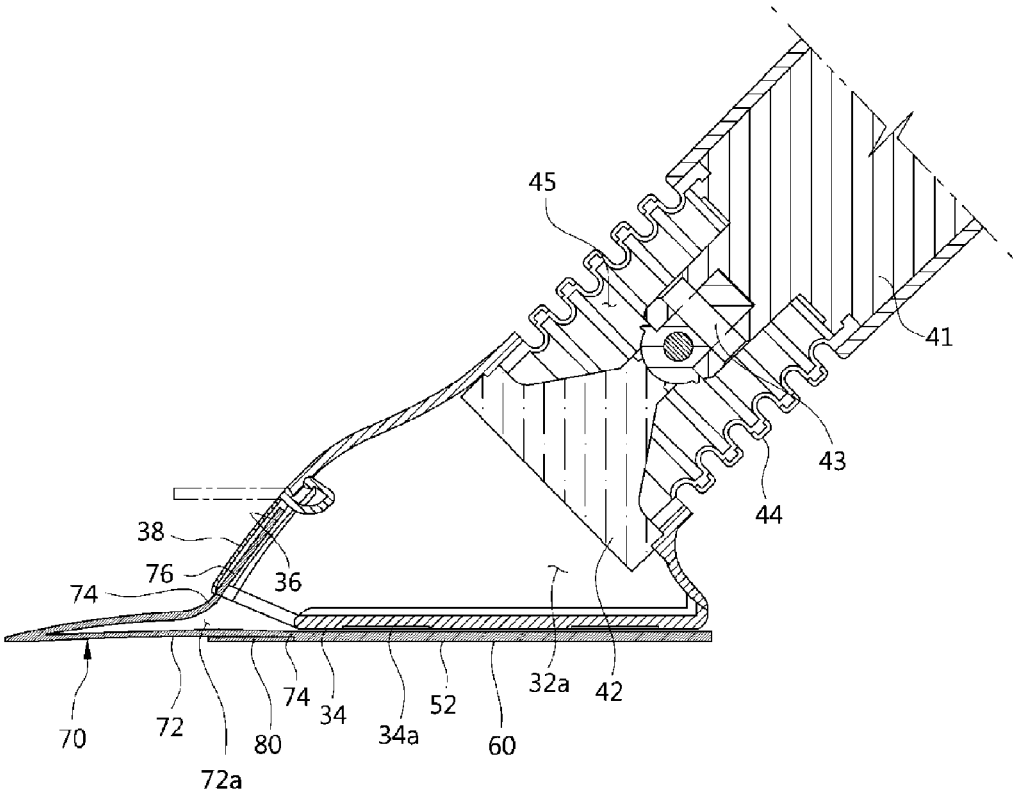
FIGS. 9A, 9B and 9C are drawings showing an operation of the cleaning member according to operation of the cleaner in accordance with the first embodiment of the present disclosure.
Figure 9B:
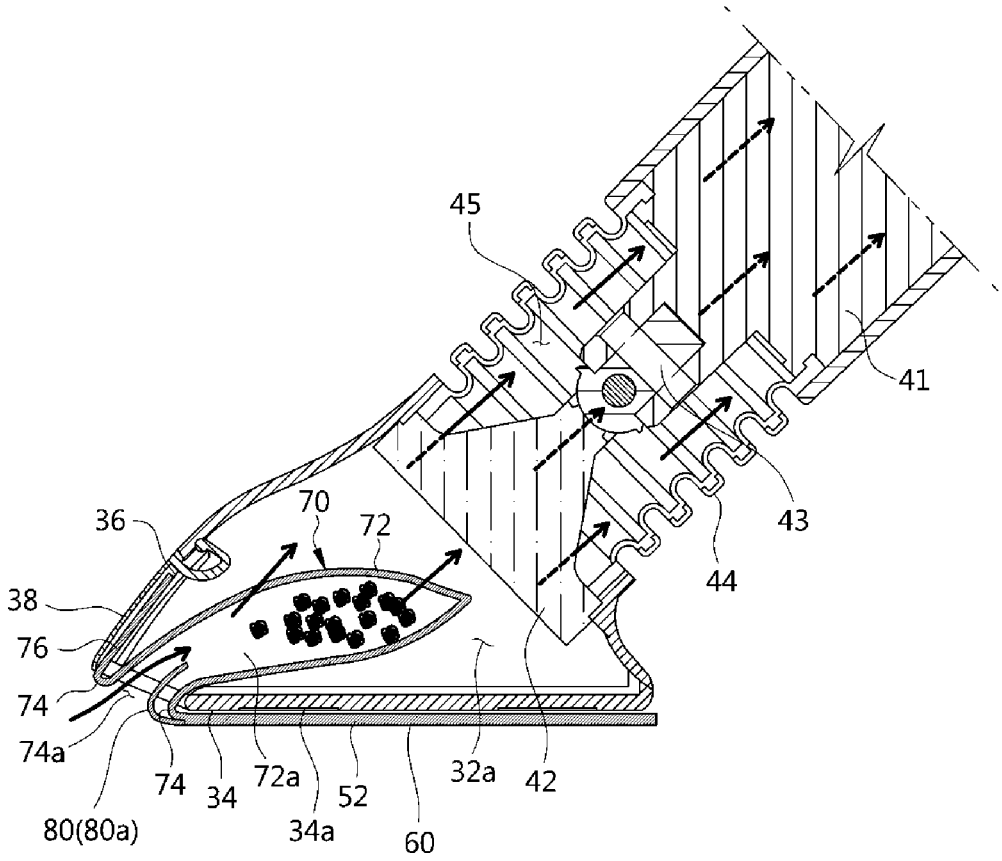
Figure 9C:
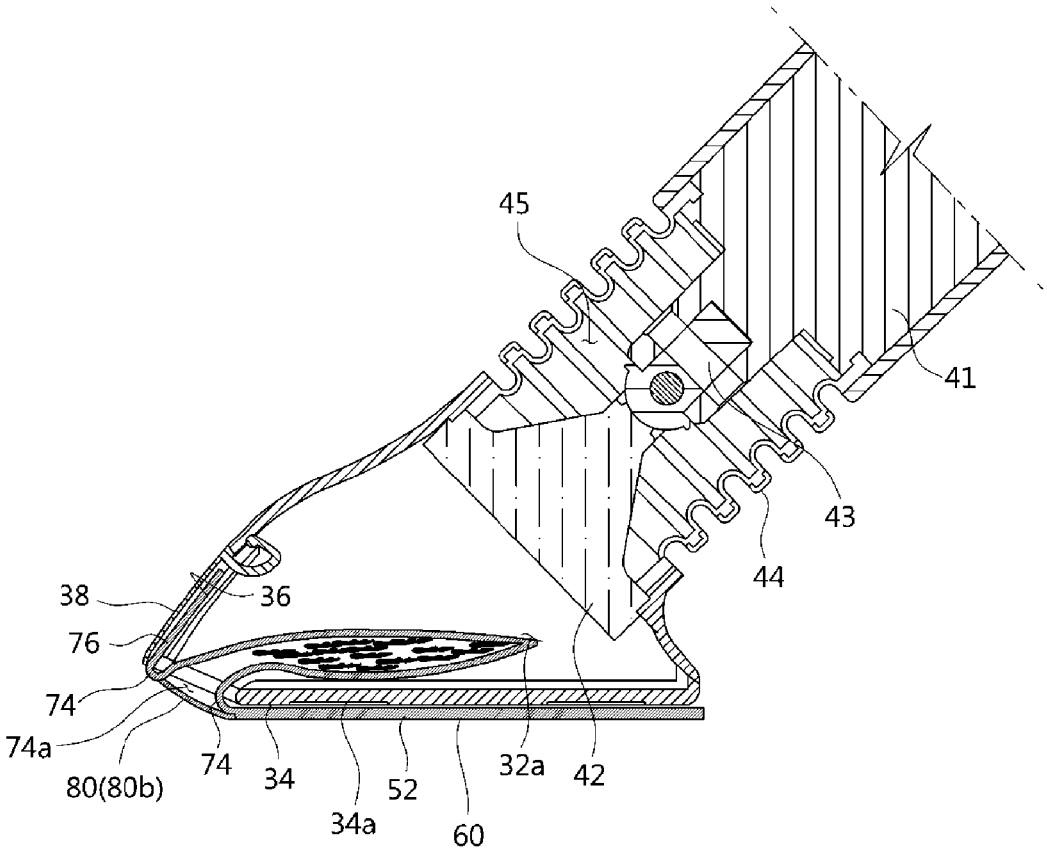

FIGS. 9A, 9B and 9C are drawings showing a state of the cleaning member operating according to operation of the cleaner in accordance with the first embodiment of the present disclosure.

Referring to FIG. 9A, when the cleaning member 50 is attached to the head unit 30 before the cleaner 1 operates, the container body 72 is provided to be exposed to the outside of the head unit 30.

In this case, as the cleaner 1 operates, the container body 72 forms the dust collecting space 72*a* inside the container body 72 due to the suction force of the driving part 14, and the container body 72 is disposed inside the head unit 30 as shown in FIG. 9B. As the cleaning operation proceeds, foreign substances on the surface to be cleaned are collected in the dust collecting container 70, and also cleaned by the bottom cleaning part 60. In this case, the backflow preventing rib 80 is disposed to be oriented toward the dust collecting space 72*a* of the container body 72 by the suction force, thereby opening the opening 74*a*.

As the cleaner 1 stops operating, the suction force is not generated by the driving part 14. The foreign substances inside the dust collecting container 70 drop to a lower side of the dust collecting space 72*a* as shown in FIG. 9C. However, since the suction force is not generated, the backflow preventing rib 80 returns to its original position, thereby closing the opening 74*a*.

Hereinafter, a process of mounting the cleaning member 50 on the cleaner 1 will be described.

FIGS. 10A to 10F are drawings showing a state of the cleaning member 50 being coupled to the cleaner 1 in accordance with the first embodiment of the present disclosure.

Figure 10A:
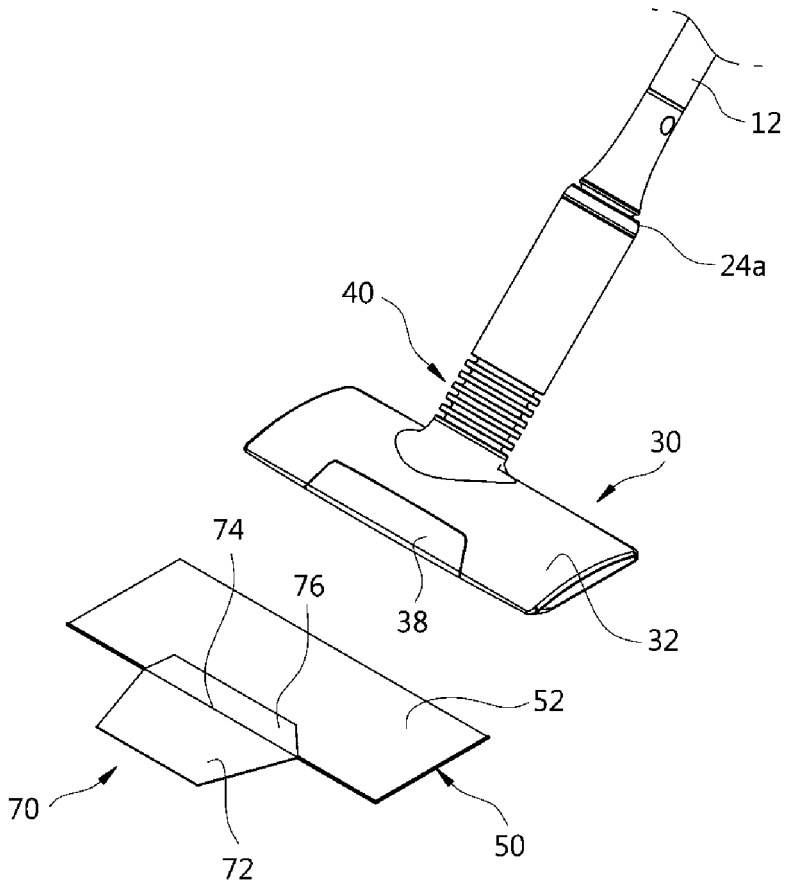
FIGS. 10A to 10F are drawings showing a state of the cleaning member being coupled to the cleaner in accordance with the first embodiment of the present disclosure.
Figure 10B:
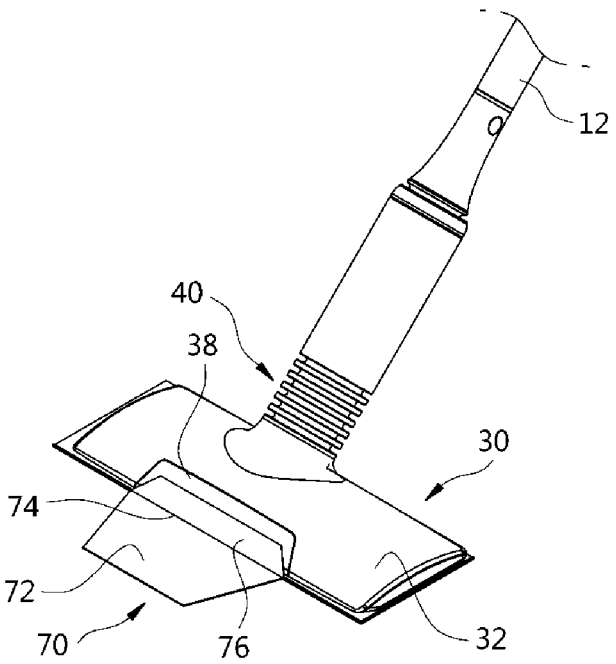
Figure 10C:
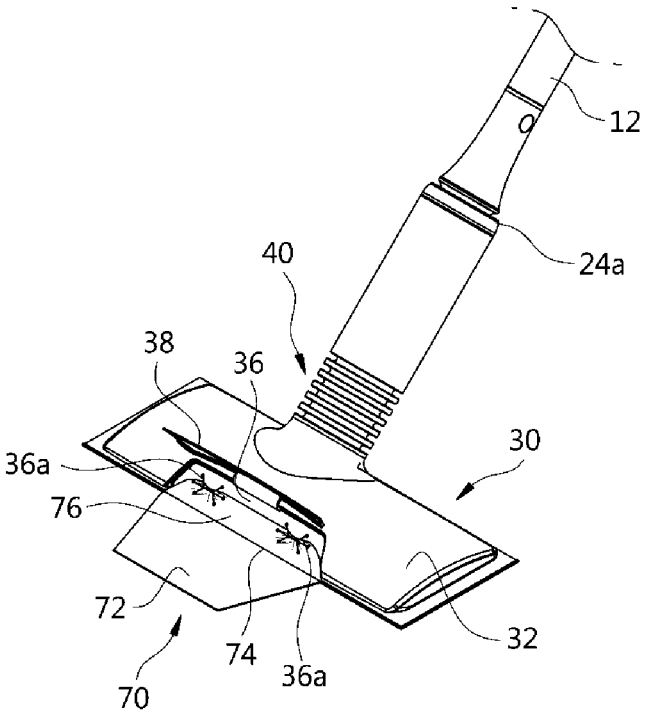

Referring to FIGS. 10A and 10B, the cleaning member 50 is attached to the lower side of the head unit 30.

Figure 10D:
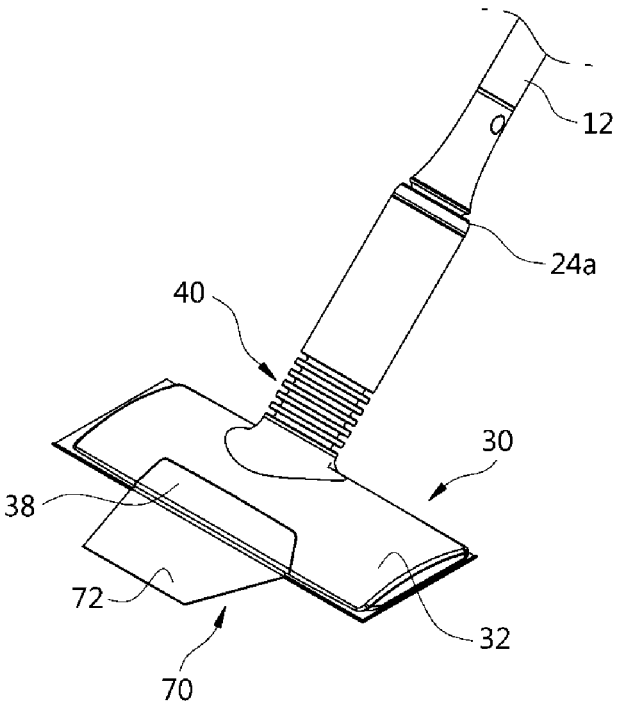

Thereafter, referring to FIGS. 100 and 10D, the fixing cover 38 of the head unit 30 is opened and a portion of the inlet fixing part 76 is introduced into the fixing part 36*a* such that the inlet part 74 of the dust collecting container 70 is fixed to be prevented from being introduced into the head unit 30 by the suction force of the driving part 14.

The fixing cover 38 is closed after the inlet fixing part 76 is fixed, and the cleaner 1 is operated.

Figure 10E:
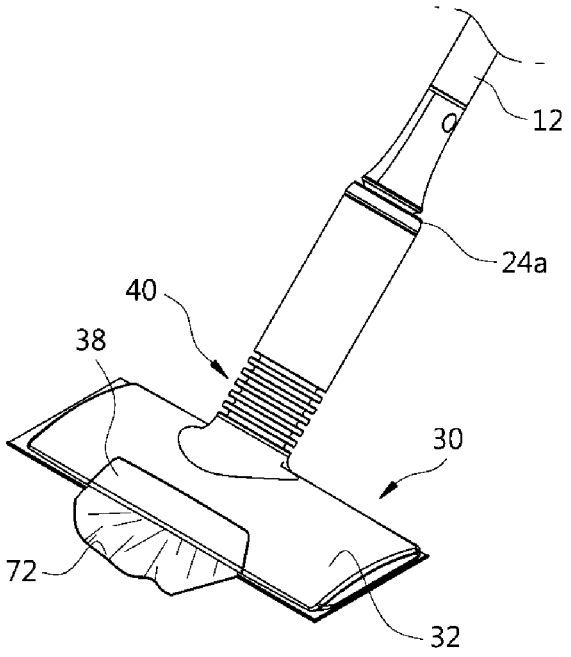
Figure 10F:
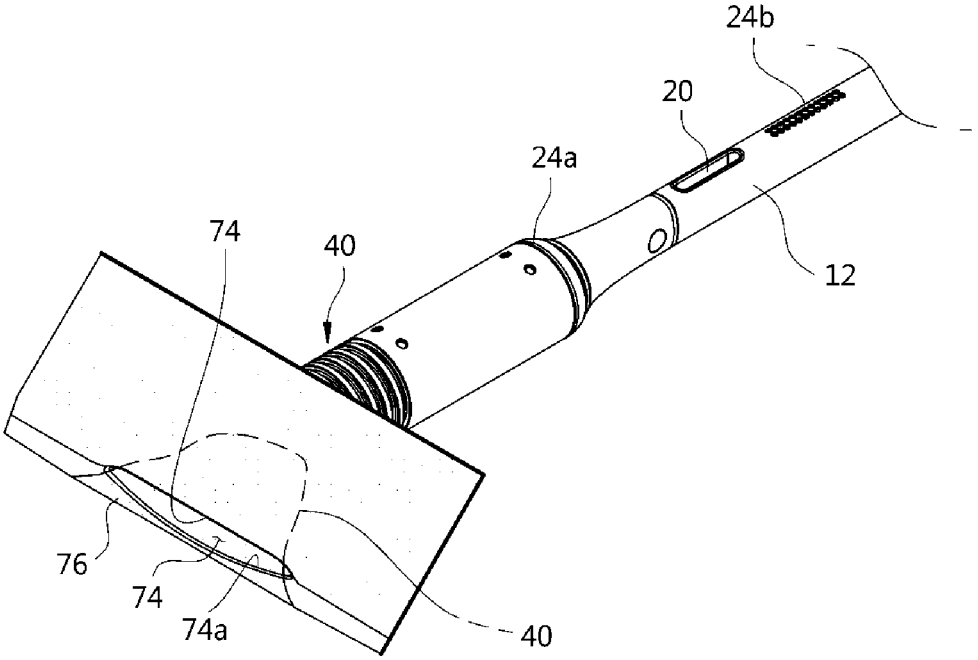

Referring to FIGS. 10E and 10F, as the cleaner 1 operates, a suction force is generated by the driving part 14, and the container body 72 of the dust collecting container 70 is introduced into the head unit 30, and the inlet part 74 is fixed by the member body 52 and the inlet fixing part 76 while forming the opening 74*a* without being introduced into the head unit 30.

Hereinafter, a cleaning member according to the second embodiment of the present disclosure and the cleaner having the same will be described.

Figure 11:
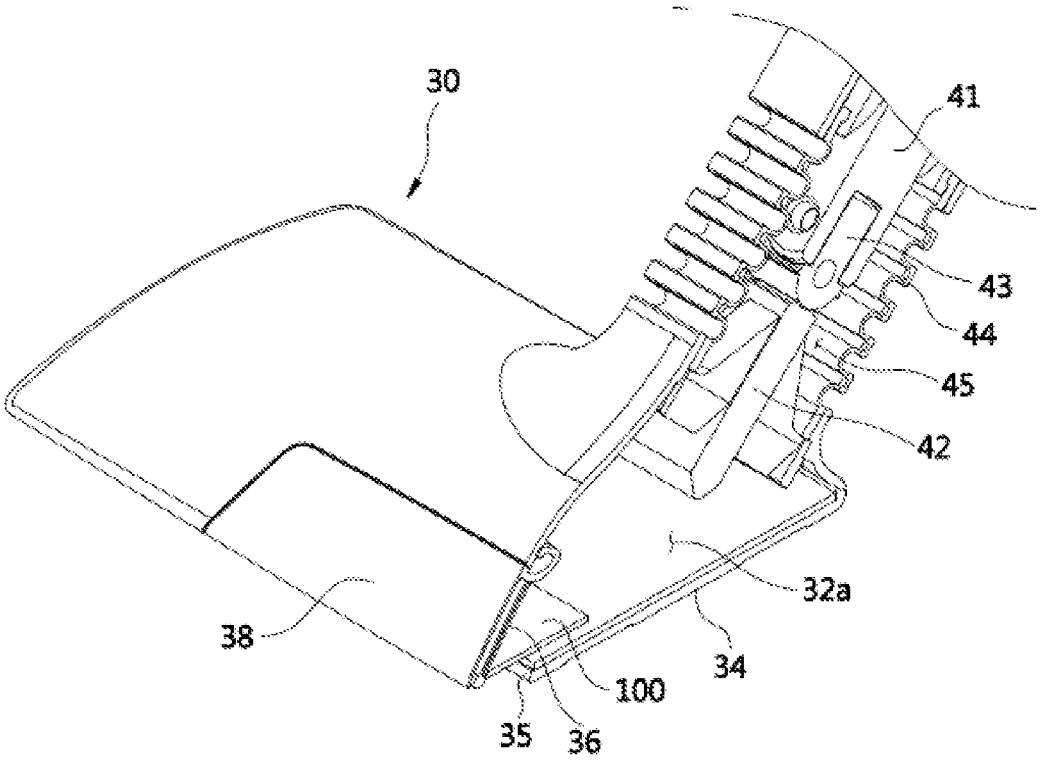
FIG. 11 is a perspective view showing a cross section of a head unit and a backflow preventing unit in accordance with the second embodiment of the present disclosure.

FIG. 11 is a perspective view showing a cross section of a head unit and a backflow preventing unit in accordance with the second embodiment of the present disclosure.

According to the second embodiment of the present disclosure, a backflow preventing unit 100 is provided to prevent foreign substances in the dust collecting container 70 from being discharged to the outside.

The backflow preventing unit 100 is provided to operate in associated with an operation of the cleaner 1. In detail, the backflow preventing unit 100 is provided to open and close the opening 74*a* of the dust collecting container 70 and the entry part 35 of the head unit 30 depending on whether the cleaner 1 operates or not.

The backflow preventing unit 100 is provided to correspond to the entry part 35, and according to the second embodiment of the present application, the backflow preventing unit 100 is provided in the form of a rib having a width corresponding to that of the entry part 35, and configured to move back and forth along a guide rail 110. In addition, according to operation of the cleaner 1, the backflow preventing unit 100 is configured to open the entry part 35 when the driving part 14 operates, and close the entry part 35 when the driving part 14 stops operating. However, the configuration of the backflow preventing unit 100 opening/closing the entry part 35 is not limited thereto, and may be provided in various forms as long as the backflow preventing unit 100 opens and closes the entry part 35 of the head unit 30 and the opening 74*a* of the dust collecting container 70.

Hereinafter, an operation of a cleaning member according to the second embodiment of the present disclosure and the cleaner having the same will be described.

Figure 12A:
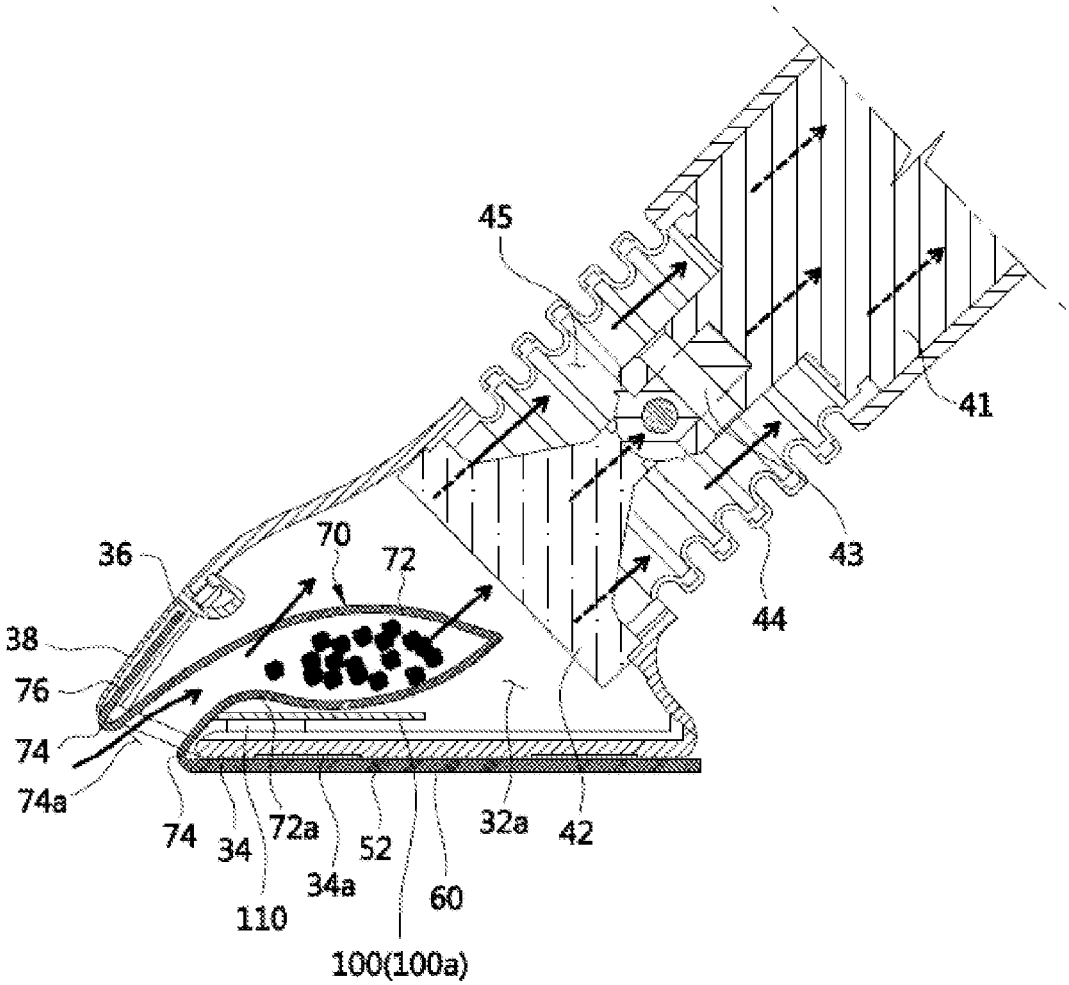
FIGS. 12A and 12B are drawings showing an operation of the backflow preventing unit according to operation of the cleaner in accordance with the second embodiment of the present disclosure.
Figure 12B:
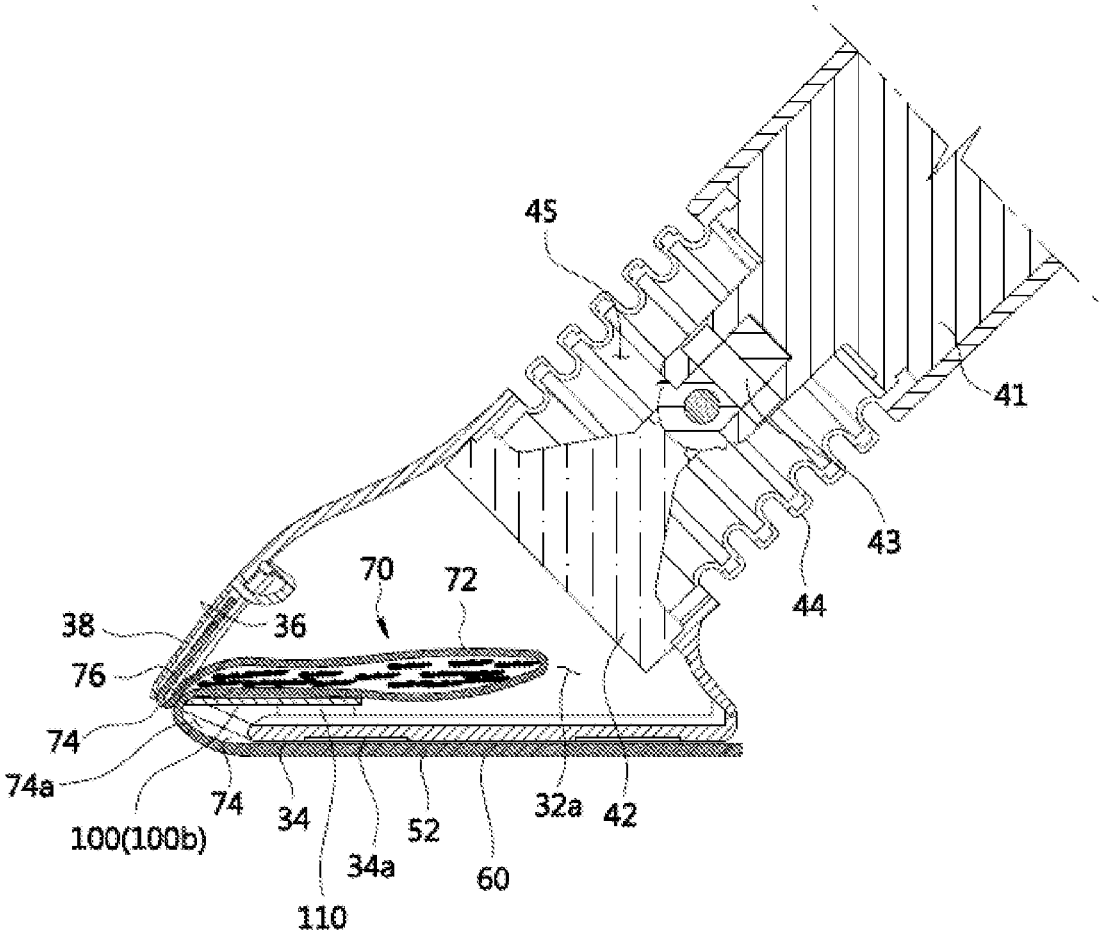

FIGS. 12A and 12B are drawings showing an operation of the backflow preventing unit according to operation of the cleaner in accordance with the second embodiment of the present disclosure.

First, when the cleaner 1 operates, the container body 72 of the dust collecting container 70 is disposed in the inner space 32*a* of the head unit 30 to filter out foreign substances of air introduced from the outside. In this case, the backflow preventing unit 100 is disposed at an opening position 100*a* such that the entry part 35 is open.

When the cleaning is completed and the driving part 14 stops operating, the backflow preventing unit 100 is moved along the guide rail 100 and disposed at a closing position 100*b* such that the entry part 35 is closed. The backflow preventing unit 100 is disposed at the closing position 100*b*, the entry part 35 of the head unit 30 is closed, and the opening 74*a* of the dust collecting container 70 is blocked, and thus foreign substances in the dust collecting container 70 are prevented from being discharged to the outside.

Although the backflow preventing unit 100 according to the second embodiment of the present disclosure operates in linkage with the operation of the driving part 14, the present disclosure is not limited thereto. For example, the backflow preventing unit 100 may operate according to a separate control regardless of the operation of the driving part 14.

Hereinafter, a cleaning member according to the third embodiment of the present disclosure and the cleaning having the same will be described.

Figure 13:
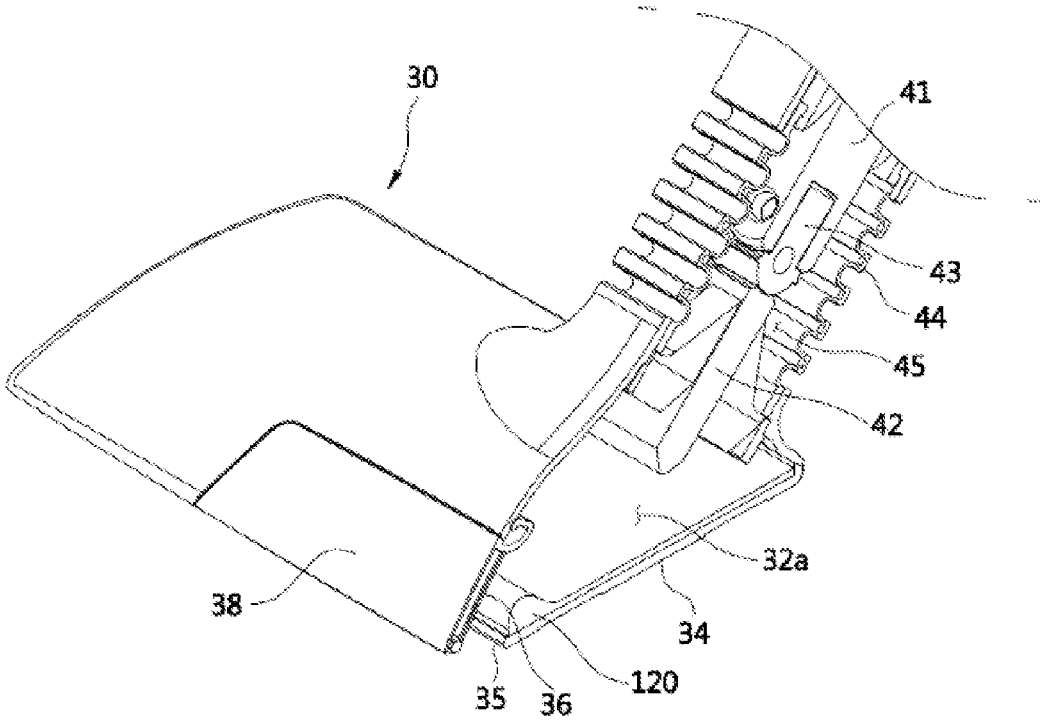
FIG. 13 is a perspective view showing a cross section of a head unit and a backflow preventing protrusion in accordance with the third embodiment of the present disclosure.

FIG. 13 is a perspective view showing a cross section of a head unit and a backflow preventing protrusion in accordance with the third embodiment of the present disclosure.

According to the third embodiment of the present disclosure, a backflow preventing protrusion 120 is provided to prevent foreign substances in the dust collecting container 70 from being discharged to the outside.

The backflow preventing protrusion 120 is formed adjacent to the entry part 35 of the head unit 30, and configured to be projected toward the inner space 32*a* of the head unit 30. The backflow preventing protrusion 120 is provided in a shape corresponding to that of the dust collecting container 70, and when the driving part 14 stops generating a suction force and the dust collecting container 70 is inclined in the inner space 32*a* due to the deadweight, the backflow preventing protrusion 120 pushes one side of the dust collecting container 70 to confine opening 74*a*.

Figure 14A:
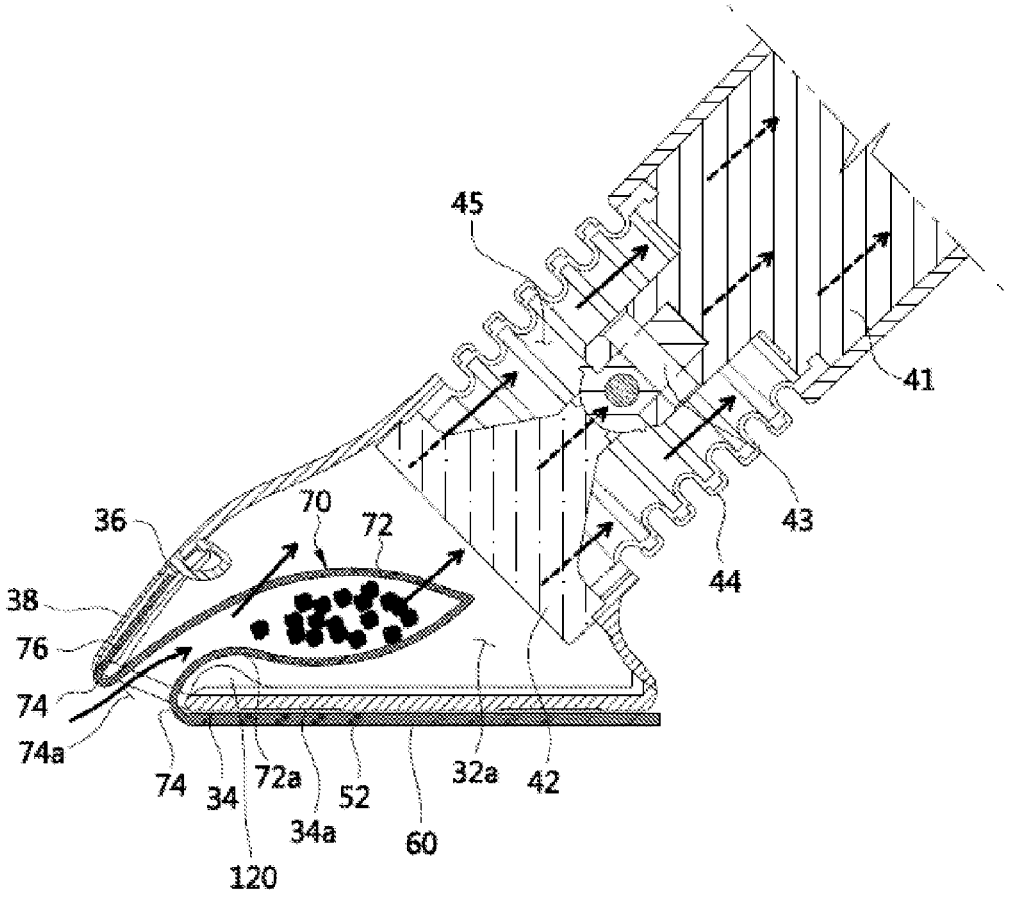
FIGS. 14A and 14B are drawings illustrating the backflow preventing protrusion and the dust collecting container according to operation of the cleaner in accordance with the third embodiment of the present disclosure.
Figure 14B:
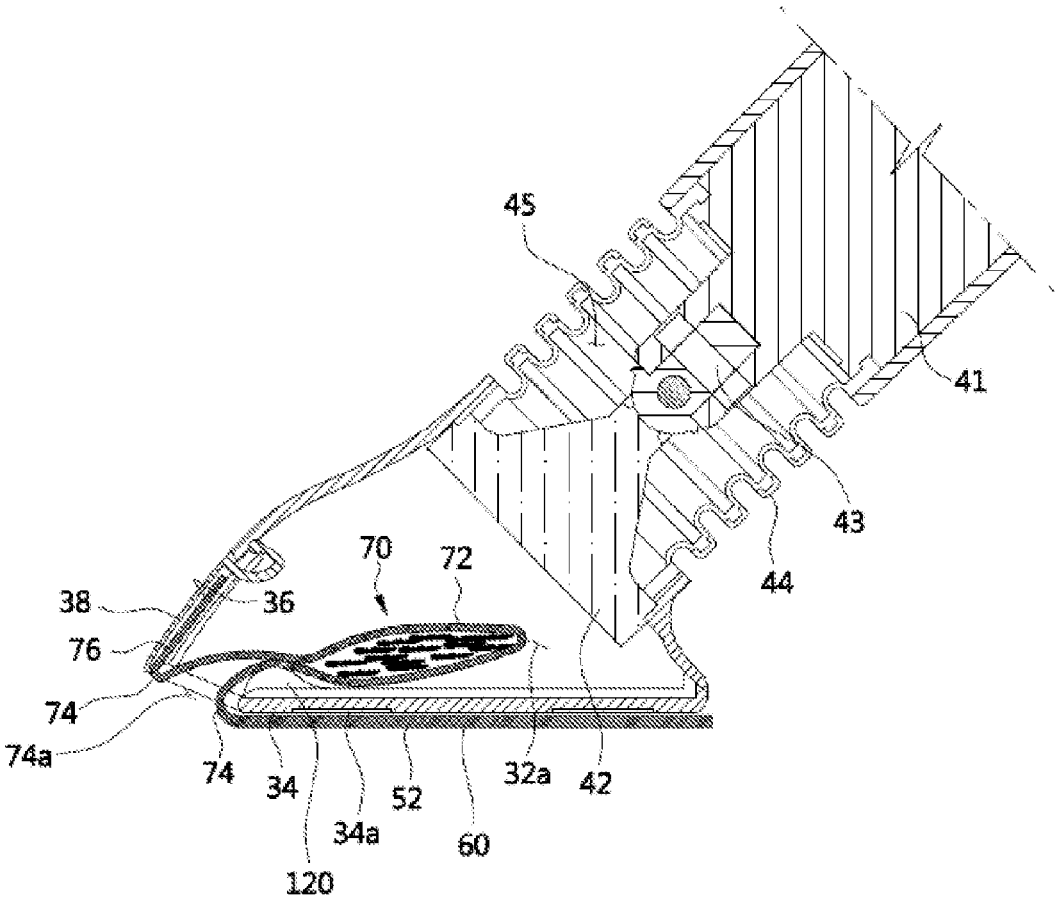

After the suctioning process of the driving part 14 is completed, the dust collecting container 70 lies down as shown in FIG. 14B, and in this process, a portion of the dust collecting container 70 is confined such that the opening 74*a* of the dust collecting container 70 becomes narrower, thereby preventing foreign substances from being discharged to the outside.

Hereinafter, an operation of the cleaning member according to the third embodiment of the present disclosure and the cleaner having the same will be described.

FIGS. 14A and 14B are drawings illustrating the backflow preventing protrusion and the dust collecting container according to operation of the cleaner in accordance with the third embodiment of the present disclosure.

Referring to FIG. 14A, while a suction force is being generated by the driving part 14, the dust collecting container 70 forms the inner space 32*a* and foreign substances are accumulated in the dust collecting container 70.

Referring to FIG. 14B, when the cleaning is completed and the driving part 14 stops operating, the dust collecting container 70 lies down due to the deadweight and the weight of foreign substances, and thus the opening 74*a* of the dust collecting container 70 is pressed by the backflow preventing protrusion 120. In this case, the opening 74*a* of the dust collecting container 70 is pressed to be narrowed, and foreign substances in the dust collecting container 70 are prevented from being discharged to the outside.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cleaner comprising:

a cleaner body provided with a driving part configured to generate a suction airflow;

a head unit comprising a head body having an inner space formed therein, a mounting part formed at a front side of the head body, a bottom surface formed on the lowermost surface of the head body, and an entry part disposed at a forward end portion of the bottom surface and rearward of the mounting part;

the front side, the forward end portion, and the bottom surface of the head unit being oriented with respect to a traveling direction of the head unit during operation of the cleaner;

the head unit being connected to the cleaner body and configured to introduce outside air through the entry part into the inner space by the suction airflow of the driving part; and a cleaning member detachably provided on the head unit, wherein the cleaning member includes an inlet fixing part for detachably coupling the cleaning member to the mounting part of the head unit;

a member body for detachably coupling the cleaning member to the bottom surface of the head unit; and a dust collecting container having an inlet part formed adjacent to the inlet fixing part and adjacent to the member body, the dust collecting container forming a dust collecting space within the cleaning member, and wherein during the operation of the cleaner, the inlet fixing part of the cleaning member is attached to the mounting part of the head unit, the member body of the cleaning member is attached to the bottom surface of the head unit to be in contact with a surface to be cleaned, and the dust collecting container extends through the entry part and into the inner space of the head unit, the cleaner being configured to draw the outside air into the suction airflow and into the dust collecting space via the inlet part and the entry part, and the dust collecting container is configured to filter out foreign substances from the suction airflow.

2. The cleaner of claim 1, wherein the dust collecting container includes:

a container body provided at an inside the head unit and having the dust collecting space in which foreign substances are collected, to perform the filtering on the suction airflow introduced into the head unit, wherein the inlet part is configured to form an opening through which the outside air is introduced into the dust collecting space, the inlet part being formed at an end portion of the container body.

3. The cleaner of claim 2, wherein the container body is disposed in the inner space of the head unit by the suction airflow of the driving part.

4. The cleaner of claim 1, wherein the dust collecting container is integrally formed with a front side of the member body.

5. The cleaner of claim 2, wherein the cleaning member further includes a backflow preventing rib that extends from the member body and is movably provided between an opening position at which the opening is opened and a closing position at which the opening is closed depending on generation of the suction airflow by the driving part.

6. The cleaner of claim 2, wherein the head unit further includes:

a backflow preventing unit provided adjacent to the entry part and configured to move back and forth to open and close the entry part and the opening.

7. The cleaner of claim 2, wherein the head unit further includes:

a backflow preventing protrusion adjacent to the entry part and configured to be projected inward the head unit to confine one side of the opening when the driving part stops generating the suction airflow and the container body is inclined due to deadweight.

8. The cleaner of claim 1, wherein the cleaning member further comprises an inside cleaning member provided inside the member body to absorb moisture.

9. The cleaner of claim 2, wherein one side of the inlet part is fixed as the member body integrally formed with the inlet part is attached to the head unit, and the other side of the inlet part is fixed as the inlet fixing part is fixed to a front surface of the head unit, so that the opening of the inlet part is kept open.

10. The cleaner of claim 2, wherein a fixing part is provided on the mounting part, the fixing part being formed of an elastic member that is radially slit to act an elastic force such that at least one portion of the inlet fixing part is introduced into the fixing part and prevented from being randomly separated.

11. The cleaner of claim 10, wherein the head unit includes a fixing cover configured to primarily cover the fixing part and secondarily fix the inlet fixing part.

12. The cleaner of claim 1, further comprising:

a joint part allowing a bottom surface of the head unit to be parallel to the surface to be cleaned when the cleaner body operates, wherein the joint part includes a flexible tube forming an external appearance of the joint part and provided to be deformable;

a plurality of joints provided in the flexible tube and allowing the head unit to perform a joint movement with respect to the cleaner body, wherein a flow path is provided between the flexible tube and the plurality of joints to allow the suction airflow suctioned by the driving part to move therealong.

13. The cleaner of claim 2, wherein the cleaner body further includes an exit part allowing the suction airflow introduced from the head unit to be discharged, wherein the entry part, the dust collecting container, the driving part and the exit part are sequentially disposed in a flow direction of air introduced from outside.

14. A cleaning member detachably provided on a cleaner provided with a head unit comprising a head body, a mounting part, a bottom surface, and an entry part disposed at a forward end portion of the bottom surface and rearward of the mounting part, the head unit being configured to introduce outside air through the entry part by the suction airflow of a driving part, the cleaning member comprising:

an inlet fixing part for detachably coupling the cleaning member to the mounting part of the head unit;

a member body for detachably coupling the cleaning member to the bottom surface of the head unit; and a dust collecting container having an inlet part formed adjacent to the inlet fixing part and adjacent to the member body, the dust collecting container forming a dust collecting space within the cleaning member, and wherein during operation of the cleaner, the inlet fixing part of the cleaning member is attached to the mounting part of the head unit, the member body of the cleaning member is attached to the bottom surface of the head unit to be in contact with a surface to be cleaned, and the dust collecting container extends through the entry part and into an inner space of the head unit, the outside air being drawn into the suction airflow into the dust collecting space via the inlet part and the entry part, and the dust collecting container being configured to filter out foreign substances from the suction airflow.

15. The cleaning member of claim 14, wherein the dust collecting container is integrally formed with a front surface of the member body.

16. The cleaning member of claim 14, wherein the inlet part provided on the dust collecting container forms an opening that allows the outside air to be introduced to the inside of the dust collecting container; and the inlet fixing part is configured to allow at least one portion of the inlet part to be fixed such that the opening is kept open, the inlet fixing part extending from the inlet part.

* * * * *